US012239162B2

(12) United States Patent
Mcguinness et al.

(10) Patent No.: US 12,239,162 B2
(45) Date of Patent: Mar. 4, 2025

(54) SMOKING SUBSTITUTE COMPONENT

(71) Applicant: Imperial Tobacco Limited

(72) Inventors: Molly Mcguinness, Liverpool (GB); Joe Pemberton, Liverpool (GB); Chris Lord, Liverpool (GB); Pete Lomas, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 411 days.

(21) Appl. No.: 17/697,276

(22) Filed: Mar. 17, 2022

(65) Prior Publication Data

US 2022/0202078 A1 Jun. 30, 2022

Related U.S. Application Data

(63) Continuation of application No. PCT/EP2020/076037, filed on Sep. 17, 2020.

(30) Foreign Application Priority Data

Sep. 20, 2019 (EP) ..... 19198605
Sep. 20, 2019 (EP) ..... 19198607

(51) Int. Cl.

| | |
|---|---|
| ***A24F 47/00*** | (2020.01) |
| ***A24F 40/10*** | (2020.01) |
| ***A24F 40/42*** | (2020.01) |
| ***A24F 40/44*** | (2020.01) |
| ***A24F 40/485*** | (2020.01) |
| ***A24F 40/65*** | (2020.01) |
| ***A24F 40/70*** | (2020.01) |

(52) U.S. Cl.
CPC ..... *A24F 40/10* (2020.01); *A24F 40/42* (2020.01); *A24F 40/44* (2020.01); *A24F 40/485* (2020.01); *A24F 40/65* (2020.01); *A24F 40/70* (2020.01)

(58) Field of Classification Search
CPC ..... A24F 40/10; A24F 40/70
See application file for complete search history.

(56) References Cited

U.S. PATENT DOCUMENTS 10,172,390 B2 * 1/2019 Nakano ..... B65B 69/0033
2014/0355969 A1 12/2014 Stern
(Continued)

FOREIGN PATENT DOCUMENTS

CN 104 287 096 B 6/2016
CN 104 287 098 B 6/2016
(Continued)

OTHER PUBLICATIONS

International Search Report and Written Opinion (PCT/EP2020/076037), dated Dec. 10, 2020, 20 pages.
(Continued)

*Primary Examiner* — Neil Abrams
(74) *Attorney, Agent, or Firm* — DUNLAP CODDING, P.C.

(57) ABSTRACT

Aerosol delivery component with a tank, and a wall separating the tank from a vaporizer, with a vent channel extending through the wall from a first opening at the chamber to a second opening at the tank and positioned such that any leakage of liquid through the channel is discharged on the vaporizer, or wherein the first opening has a greater cross-sectional area than the second opening.

15 Claims, 4 Drawing Sheets

(56) References Cited

U.S. PATENT DOCUMENTS

| | | | | |
|---|---|---|---|---|
| 2015/0090279 | A1 | 4/2015 | Chen | |
| 2017/0173278 | A1 | 6/2017 | Buchberger et al. | |
| 2017/0295846 | A1 | 10/2017 | Liu | |
| 2018/0000159 | A1 | 1/2018 | Rogan | |
| 2018/0303166 | A1* | 10/2018 | Qiu | A61M 15/06 |
| 2018/0310616 | A1 | 11/2018 | Clemens et al. | |
| 2019/0022345 | A1 | 1/2019 | Kotch | |
| 2019/0046745 | A1 | 2/2019 | Nettenstrom et al. | |
| 2019/0124997 | A1 | 5/2019 | Qiu | |
| 2019/0191769 | A1 | 6/2019 | Kurian et al. | |

FOREIGN PATENT DOCUMENTS

| | | | |
|---|---|---|---|
| CN | 109 259 318 | A | 1/2019 |
| WO | WO 2017/031678 | A1 | 3/2017 |
| WO | WO 2018/046315 | A1 | 3/2018 |
| WO | WO 2019/057956 | A1 | 3/2019 |

OTHER PUBLICATIONS

International Search Report (19198605.8-1004), dated Mar. 31, 2020, 7 pages.

International Search Report (19198607.4-1004), dated Mar. 26, 2020, 7 pages.

* cited by examiner

SMOKING SUBSTITUTE COMPONENT

CROSS-REFERENCE TO RELATED APPLICATIONS/INCORPORATION BY REFERENCE STATEMENT

This application is a non-provisional application claiming benefit to the international application no. PCT/EP2020/076037 filed on Sep. 17, 2020, which claims priority to EP 19198605.8 filed on Sep. 20, 2019 and EP 19198607.4 filed on Sep. 20, 2019. The entire contents of each of the above-referenced applications are hereby incorporated herein by reference in their entirety.

TECHNICAL FIELD

The present disclosure relates to an aerosol-delivery component, which may be a consumable for receipt in an aerosol-delivery device to form an aerosol-delivery system (e.g., a smoking substitute system).

BACKGROUND

The smoking of tobacco is generally considered to expose a smoker to potentially harmful substances. It is generally thought that a significant amount of the potentially harmful substances are generated through the heat caused by the burning and/or combustion of the tobacco and the constituents of the burnt tobacco in the tobacco smoke itself.

Combustion of organic material such as tobacco is known to produce tar and other potentially harmful by-products. There have been proposed various smoking substitute systems in order to avoid the smoking of tobacco.

Such smoking substitute systems can form part of nicotine replacement therapies aimed at people who wish to stop smoking and overcome a dependence on nicotine.

Smoking substitute systems, which may also be known as electronic nicotine delivery systems, may comprise electronic systems that permit a user to simulate the act of smoking by producing an aerosol, also referred to as a "vapor", which is drawn into the lungs through the mouth (inhaled) and then exhaled. The inhaled aerosol typically bears nicotine and/or flavorings without, or with fewer of, the odor and health risks associated with traditional smoking.

In general, smoking substitute systems are intended to provide a substitute for the rituals of smoking, whilst providing the user with a similar experience and satisfaction to those experienced with traditional smoking and tobacco products.

The popularity and use of smoking substitute systems has grown rapidly in the past few years. Although originally marketed as an aid to assist habitual smokers wishing to quit tobacco smoking, consumers are increasingly viewing smoking substitute systems as desirable lifestyle accessories. Some smoking substitute systems are designed to resemble a traditional cigarette and are cylindrical in form with a mouthpiece at one end. Other smoking substitute systems do not generally resemble a cigarette (for example, the smoking substitute device may have a generally box-like form).

There are a number of different categories of smoking substitute systems, each utilizing a different smoking substitute approach. A smoking substitute approach corresponds to the manner in which the substitute system operates for a user.

One approach for a smoking substitute system is the so-called "vaping" approach, in which a vaporizable liquid, typically referred to (and referred to herein) as "e-liquid", is heated by a heater to produce an aerosol vapor which is inhaled by a user. An e-liquid typically includes a base liquid as well as nicotine and/or flavorings. The resulting vapor therefore typically contains nicotine and/or flavorings. The base liquid may include propylene glycol and/or vegetable glycerin.

A typical vaping smoking substitute system includes a mouthpiece, a power source (typically a battery), a tank or liquid reservoir for containing e-liquid, as well as a heater. In use, electrical energy is supplied from the power source to the heater, which heats the e-liquid to produce an aerosol (or "vapor") which is inhaled by a user through the mouthpiece.

Vaping smoking substitute systems can be configured in a variety of ways. For example, there are "closed system" vaping smoking substitute systems which typically have a heater and a sealed tank which is pre-filled with e-liquid and is not intended to be refilled by an end user. One subset of closed system vaping smoking substitute systems include a device which includes the power source, wherein the device is configured to be physically and electrically coupled to a consumable component including the tank and the heater. In this way, when the tank of the consumable component has been emptied, the device can be reused by connecting it to a new consumable component. Another subset of closed system vaping smoking substitute systems are completely disposable, and intended for one-use only.

There are also "open system" vaping smoking substitute systems which typically have a tank that is configured to be refilled by a user, so the system can be used multiple times.

An example vaping smoking substitute system is the Myblu™ e-cigarette. The Myblu™ e cigarette is a closed system which includes a device and a consumable component. The device and consumable component are physically and electrically coupled together by pushing the consumable component into the device. The device includes a rechargeable battery. The consumable component includes a mouthpiece, a sealed tank which contains e-liquid, as well as a vaporizer, which for this system is a heating filament coiled around a portion of a wick which is partially immersed in the e-liquid. The system is activated when a microprocessor on board the device detects a user inhaling through the mouthpiece. When the system is activated, electrical energy is supplied from the power source to the vaporizer, which heats e-liquid from the tank to produce a vapor which is inhaled by a user through the mouthpiece.

Another example vaping smoking substitute system is the blu PRO™ e-cigarette. The blu PRO™ e cigarette is an open system which includes a device, a (refillable) tank, and a mouthpiece. The device and tank are physically and electrically coupled together by screwing one to the other. The mouthpiece and refillable tank are physically coupled together by screwing one into the other, and detaching the mouthpiece from the refillable tank allows the tank to be refilled with e-liquid. The system is activated by a button on the device. When the system is activated, electrical energy is supplied from the power source to a vaporizer, which heats e-liquid from the tank to produce a vapor which is inhaled by a user through the mouthpiece.

As the vapor passes through the consumable (entrained in the airflow) from the location of vaporization to an outlet of the consumable (e.g., a mouthpiece), the vapor cools and condenses to form an aerosol for inhalation by the user. The aerosol may contain nicotine and/or flavor compounds.

As e-liquid is released from the tank and vaporized, a pressure differential is created between the inside of the tank and the rest of the system. If the pressure differential between the tank and the rest of the system is not equalized, further e-liquid cannot be drawn out by the wick from the tank. The wick therefore cannot become moistened or saturated with e-liquid and the user ends up inhaling air without the aerosol (or 'vapor') being produced. This is otherwise known as a 'dry hit'.

In order for further e-liquid to be drawn out from the tank by the wick, the volume occupied by the released e-liquid in the tank must be replaced by air. In other words, air must be able to enter the e-liquid tank and replace the volume created by the released vaporized e-liquid. By allowing air to enter the tank, the pressure differential between the tank and the rest of the system is equalized, thereby allowing the wick to draw out further e-liquid from the tank.

Prior art vaping smoking substitute systems have attempted to equalize this pressure differential by providing an air vent in the tank to allow air to enter the tank. However, providing a vent in the tank often results in e-liquid leaking from the tank.

There is a need for an improved system which ameliorates the problem described above.

SUMMARY

According to a first aspect there is a provided an aerosol-delivery component, comprising: a tank for containing a liquid aerosol precursor; a vaporizing chamber housing a vaporizer; a wall separating the vaporizing chamber from the tank; and a vent channel extending through the wall from a first opening at the vaporizing chamber to a second opening at the tank, the vent channel being configured such that leakage of aerosol precursor through the channel is discharged onto the vaporizer.

By providing a vent channel that is configured such that leakage of aerosol precursor through the channel is discharged onto the vaporizer, any aerosol precursor that leaks from the tank will be contained within the vaporizer and is less likely to leak out of the vaporizing chamber.

Optional features of the first aspect will now be set out. These are applicable singly or in any combination with any aspect.

In some embodiments, the vent channel is configured to discharge directly onto the vaporizer. There may be no components or parts between the vent channel and the vaporizer, i.e., there is a clear, unobstructed pathway between the first opening and the vaporizer, such that any aerosol precursor that leaks from the tank will be discharged directly onto the vaporizer.

The vent channel may be an elongate channel or passage that extends through the wall.

The vent channel may be vertically above/vertically aligned with the vaporizer, i.e., the elongate/longitudinal axis of the vent channel may intersect the vaporizer.

The vaporizer may have a length and a width each substantially perpendicular to a longitudinal axis of the component such that the vaporizer extends transversely across the component. The vaporizer may have an elongate shape where the length of the vaporizer is greater than the width and depth of the vaporizer. The longitudinal axis of the elongate vent channel may intersect may intersect with the width and/or length dimension of the vaporizer.

The vaporizer may comprise a heating element for heating a wick.

The vent channel may be vertically above/vertically aligned with the wick, i.e., the elongate/longitudinal axis of the vent channel may intersect the wick.

The wick may have a length and a width each substantially perpendicular to the longitudinal axis of the component such that the wick extends transversely across the component. The wick may have an elongate shape where the length of the wick is greater than the width and depth of the wick. The longitudinal axis of the elongate vent channel may intersect may intersect with the width and/or length dimension of the wick.

The vaporizer/wick has opposing first and second longitudinal ends (spaced by the length of the vaporizer/wick). The axis of the vent channel preferably intersects the vaporizer/wick at a position that is spaced from the first longitudinal end of the vaporizer. The axis of the vent channel preferably intersects the vaporizer/wick at a position that is spaced from the second longitudinal end of the vaporizer.

The axis of the vent channel preferably intersects the vaporizer/wick at a position that is spaced from both the first and the second longitudinal ends of the vaporizer, e.g., at a position equi-distant from the first and second longitudinal ends. In other words, the vent channel is transversely centered along the length of the wick.

The axis of the vent channel preferably intersects the longitudinal axis of the vaporizer/wick such that the axis of the vent channel is centered in the width dimension of the vaporizer/wick.

In especially preferred embodiments the axis of the vent channel intersects the longitudinal axis of the vaporizer/wick at a position equidistant from the longitudinal ends of the vaporizer/wick such that the axis of the vent channel is centered in both the length and width dimensions of the vaporizer/wick.

As discussed above, the vent channel is vertically above/vertically aligned with the wick. Accordingly, at least a portion of the first opening is positioned such that it overlies the vaporizer/wick.

Preferably, the entire cross-sectional area of the first opening (in a plane extending perpendicularly to a longitudinal axis of the component) overlies the vaporizer/wick. To facilitate this, the maximum dimension of the first opening is less than or equal to the smaller of the width and length dimension of the vaporizer/wick.

In some embodiments, the first opening is circular. In these embodiments, the diameter of the first opening is equal to or smaller than the smaller of the width and length dimensions of the vaporizer/wick.

The first opening may have a greater cross-sectional area than the second opening.

In some embodiments, the vent channel comprises a channel that tapers outwardly from the second opening to the first opening, i.e., the cross-sectional area of the vent channel (in a plane extending perpendicularly to a longitudinal axis of the vent channel) may increase or widen toward the first opening.

The vent channel may taper outwardly evenly/uniformly from the second opening to the first opening, i.e., the cross-sectional area of the vent channel may increase gradually/constantly from the second opening to the first opening.

In some embodiments, the vent channel has a uniform cross-sectional profile, i.e., the cross-sectional profile/shape may remain constant along the length of the vent channel. For example, the vent channel may have a circular cross-sectional profile. Where the vent channel has a uniform circular cross-sectional profile and the vent channel tapers uniformly, the vent channel is frustoconical. The vent channel may be in the shape of a frustum where the first and second openings are the top and bottom ends of the frustum.

According to a second aspect there is provided an aerosol-delivery component comprising: a tank for containing a liquid aerosol precursor; a vaporizing chamber; a wall separating the vaporizing chamber from the tank; and a vent channel extending through the wall from a first opening at the vaporizing chamber to a second opening at the tank, the first opening having a greater cross-sectional area than the second opening.

By providing a vent channel from a first opening at the vaporizing chamber to a second opening at the tank with a first opening having a greater cross-sectional area than the second opening, the vent channel can advantageously allow air to pass through the channel (from the first opening to the second opening) but not liquid aerosol precursor (e.g., e-liquid) (from the second opening to the first opening). This allows air to enter the tank to equalize the pressure difference between the tank and the rest of the system and prevent liquid aerosol precursor/e-liquid from leaking out of the tank.

Optional features of the second aspect will now be set out. These are applicable singly or in any combination with any aspect.

In some embodiments, the vent channel comprises a channel that tapers outwardly from the second opening to the first opening. In other words, the cross-sectional area of the vent channel (in a plane extending perpendicularly to a longitudinal axis of the vent channel) may increase or widen towards the first opening.

The vent channel may taper outwardly evenly/uniformly from the second opening to the first opening, that is, the cross-sectional area of the vent channel may increase gradually/constantly from the second opening to the first opening.

In some embodiments, the vent channel has a uniform cross-sectional profile, i.e., the cross-sectional profile/shape may remain constant along the length of the vent channel.

In some embodiments, for example, the vent channel may have a circular cross-sectional profile.

Where the vent channel has a uniform circular cross-sectional profile and the vent channel tapers uniformly, the vent channel is frustoconical. The vent channel may be in the shape of a frustum where the first and second openings are the top and bottom ends of the frustum.

The first and second openings are sized to allow air to pass therethrough, i.e., to allow air to pass from the vaporizing chamber to the tank.

The second opening is sized to prevent flow of liquid aerosol precursor therethrough, i.e., to prevent flow of liquid aerosol precursor from the tank to the vaporizing chamber. Flow of liquid aerosol precursor through the second opening may be prevented due to the surface tension of the liquid aerosol precursor.

The vent channel may be an elongate channel or passage that extends through the wall.

The wall separating the vaporizing chamber from the tank may comprise an upper surface.

The component may comprise a vaporizer. The vaporizer may comprise a heating element for heating a wick. Thus, the wick may be disposed between the tank and the base of the housing.

The vent channel may be vertically above the wick (i.e., the elongate axis of the vent channel may intersect the wick).

The wick may have an elongate shape. The axis of the vent channel and the axis of the elongate wick may be perpendicular to one another.

Optional features of the first and second aspects will now be set out. These are applicable singly or in any combination with any aspect.

The (e.g., longitudinal) axis of the elongate vent channel may be parallel to an elongate axis of the component. In these embodiments, the vent channel extends through a transverse wall separating the vaporizing chamber from the tank. The transverse wall has opposing first and second transverse ends. The vent channel is preferably transversely spaced from the first transverse end of the transverse wall. The vent channel is preferably transversely spaced from the second transverse end of the transverse wall.

In some embodiments, the (e.g., longitudinal) axis of the elongate vent channel is coaxial with the elongate axis of the component. In these embodiments, the vent channel may be equally transversely spaced from both the first and second transverse ends of the transverse wall.

In some embodiments, the upper surface of the transverse wall defines a lower end of the tank and a lower surface of the transverse wall defines an upper end of the vaporizing chamber. In these embodiments, the first opening is formed in the lower surface of the transverse wall and the second opening is formed in the upper surface of the transverse wall.

The component comprises an airflow path that extends from an air inlet to an air outlet. The air outlet is provided in a mouthpiece portion, e.g., a mouthpiece portion of a component housing.

The air outlet/mouthpiece portion may be provided at a first lateral end of the housing. The housing may comprise a base portion at the opposing lateral end.

The air flow path passes the vaporizer between the air inlet to the air outlet. The vaporizer may be housed in the vaporizing chamber.

The air flow path may comprise a first portion extending from the air inlet towards the base portion of the housing (and away from the mouthpiece portion), e.g., in a substantially longitudinal direction.

The airflow path may comprise a second portion which passes the vaporizer, e.g., passes through the vaporizing chamber.

The airflow path may comprise a third portion extending longitudinally from the second portion to the air outlet (formed in the mouthpiece portion of the housing).

In this respect, a user may draw air into and along the airflow path by inhaling at the air outlet (i.e., using the mouthpiece portion).

The third portion of the airflow path may be substantially parallel to the first portion of the airflow path. The third portion of the airflow path may be longer (i.e., in a longitudinal direction) than the first airflow path. The second portion of the airflow path may be a transverse portion, i.e., extending substantially perpendicular to the first and/or third portions of the airflow path.

The airflow path may be generally U-shaped (the first and third portions forming stems of the "U" and the second portion forming the base of the "U"). In this respect, the second portion of the airflow path may connect the first and third portions of the airflow path. The airflow path may comprise at least two turns (e.g., each of around 90°) between the inlet and the vaporizer. The airflow path may comprise at least one turn between the vaporizer and the outlet.

The component comprises the tank for housing an aerosol precursor (e.g., a liquid aerosol precursor). The aerosol precursor may comprise an e-liquid, for example, comprising a base liquid and, e.g., nicotine. The base liquid may include propylene glycol and/or vegetable glycerin. Hence, the component may be a vaping smoking substitute component.

The second portion of the airflow path may be disposed between (i.e., longitudinally between) the tank and the base portion of the housing. The tank may be disposed between (in a transverse direction) the first and the third portions of the airflow path.

References to "downstream" in relation to the air flow path are intended to refer to the direction towards the air outlet/mouthpiece portion. Thus, the second and third portions of the air flow path are downstream of the first portion of the air flow path. Conversely, references to "upstream" are intended to refer to the direction towards the air inlet. Thus, the first portion of the air flow path (and the air inlet) is upstream of the second/third portions of the air flow path (and the air outlet/mouthpiece portion).

As discussed above, the component housing may comprise a mouthpiece portion (with the air outlet) at a first lateral end and a base portion at the opposing lateral end.

The housing may further comprise one or more side walls (e.g., laterally opposed first and second side walls) extending longitudinally between the mouthpiece portion and the base portion.

The air inlet may be provided in the first side wall, longitudinally spaced (towards the mouthpiece portion) from the base portion.

The air inlet may be longitudinally spaced from the base portion/lower end of the housing by a distance that is greater than 8 mm. The distance may be greater than 10 mm, or, e.g., greater than 13 mm.

The housing may further comprise opposing front and rear walls spaced by the laterally opposed first and second side walls. The distance between the first and second side walls of the housing may define a width of the housing. The distance between the front and rear walls may define a depth of the housing. The width of the housing may be greater than the depth of the housing.

The length of the housing may be greater than the width of the housing. The depth of the housing may be smaller than each of the width and the length. In this respect, the component may be an elongate component having an elongate (longitudinal) axis. As discussed above, the elongate/longitudinal axis of the vent channel may be parallel to or axially aligned with the elongate axis of the component.

The first portion of the airflow path may be defined within an inlet passage between a wall of the tank and a wall of the housing. The wall of the housing partly defining the first portion of the airflow path may be the first side wall of the housing. The wall of the tank defining the first portion of the airflow path may be a first tank wall. Thus, the first portion of the airflow path/inlet passage may be defined between the first tank wall and the first side wall. The first side wall and the first tank wall may be integrally formed with one another.

The third portion of the airflow path may be defined within an outlet passage between a wall of the tank and a wall of the housing. The wall of the housing partly defining the third portion of the airflow path may be the second side wall of the housing. The wall of the tank defining the third portion of the airflow path may be a second tank wall. Thus, the third portion of the airflow path/outlet passage may be defined between the second tank wall and the second side wall. The second side wall and the second tank wall may be integrally formed with one another.

All of the first side wall, second side wall, first tank wall and second tank wall may all be integrally formed and may additionally be integrally formed with the mouthpiece portion. In that way, the component may be easily manufactured using injection molding.

References to "upper", "lower", "above" or "below" are intended to refer to the component when in an upright/vertical orientation, i.e., with elongate (longitudinal/length) axis of the component vertically aligned and with the mouthpiece portion vertically uppermost and the base portion lowermost.

The tank may be disposed between (in a transverse direction) the first and the third portions of the airflow path.

The first and second tank walls may be spaced from one another so as to define the tank therebetween. The first and second tank walls may extend longitudinally from the mouthpiece portion towards the base portion of the housing. The first and second tank walls may be substantially parallel. Each of the first and second tank walls may extend between (and span) the front and rear walls of the housing.

Each of the first and second tank walls may extend from the mouthpiece portion (i.e., internally in the housing). Each of the first and second tank walls may be integrally formed with the mouthpiece portion.

The tank may be partly defined by a wall of the housing (e.g., the front or rear wall). At least a portion of one of the walls defining the tank may be translucent or transparent. That is, the tank may comprise a window to allow a user to visually assess the quantity of e-liquid in the tank. The tank may be referred to as a "clearomizer" if it includes a window, or a "cartomizer" if it does not.

As discussed above, the air flow path passes the vaporizer between the air inlet to the air outlet. The vaporizer/wick may be disposed between the tank and the base portion of the housing.

The vaporizer/wick may be disposed in the second portion of the air flow path.

The wick may extend across the second (transverse) portion of the air flow path. The wick may be oriented so as to extend in a direction from the front wall to the rear wall of the housing, i.e., it may be oriented in the direction of the depth dimension of the component. Thus, the wick may extend in a direction perpendicular to the direction of air flow in the second portion of the air flow path.

The vaporizer may be disposed in the vaporizing chamber. The vaporizing chamber may form part of the airflow path (i.e., the second portion of the airflow path).

The vaporizing chamber may be defined by one or more chamber walls. The wick may extend between first and second opposing chamber walls. The first and second chamber walls may separate (i.e., partially separate) the vaporizing chamber from the tank. The first and second chamber walls may each comprise a respective opening through which a respective end of the wick projects such that the wick is fluid communication with aerosol precursor/e-liquid in the tank. In this way a central portion of the wick may be exposed to air in the (second portion of the) airflow path and end portions of the wick may be in contact with aerosol precursor/e-liquid stored in the tank. The wick may comprise a porous material. Thus, aerosol precursor may be drawn (e.g., by capillary action) along the wick, from the tank to the exposed portion of the wick.

As discussed above, the vent channel may be provided in a transverse wall. The transverse wall may be a transverse chamber wall separating the vaporizing chamber from liquid aerosol precursor in the tank. In this respect, the transverse chamber wall may partly define the (base of the) tank.

The vent channel may be transversely spaced from the first tank wall. The vent channel may be transversely spaced from the second tank wall. The vent channel may be equally transversely spaced between the first and second tank wall (with the elongate/longitudinal axis of the vent channel axially aligned with the elongate/longitudinal axis of the component).

The vaporizing chamber may be defined by an insert (e.g., an insert at least partially formed of silicone) received into an open (e.g., lower) end of the housing. The vaporizing chamber walls may be walls of the insert. Thus, the vent channel may be provided in a transverse wall of the insert (which is the transverse wall of the vaporizing chamber). The insert may seal against the first and second tank walls so as to seal the tank.

The wick may be cylindrical. The heating element may be in the form of a filament wound about the wick (e.g., the filament may extend helically about the wick). The filament may be wound about the exposed portion of the wick (i.e., the portion of the wick extending across the airflow path). The heating element may be electrically connectable (or connected) to a power source. Thus, in operation, the power source may supply electricity to (i.e., apply a voltage across) the heating element so as to heat the heating element. This may cause liquid stored in the wick (i.e., drawn from the tank) to be heated so as to form a vapor and become entrained in fluid flowing along the airflow path. This vapor may subsequently cool to form an aerosol in the airflow path (e.g., the third portion of the airflow path).

In a third aspect there is provided an aerosol-delivery system (e.g., a smoking substitute system) comprising a component according to the first or second aspect and an aerosol-delivery (e.g., smoking substitute) device.

The component may be an aerosol-delivery (e.g., a smoking substitute) consumable, i.e., in some embodiments the component may be a consumable component for engagement with the aerosol-delivery (e.g., a smoking substitute) device to form the aerosol-delivery (e.g., s smoking substitute) system.

The device may be configured to receive the consumable component. For example, the device and the consumable component may be configured to be physically coupled together. For example, the consumable component may be at least partially received in a recess of the device, such that there is snap engagement between the device and the consumable component. Alternatively, the device and the consumable component may be physically coupled together by screwing one onto the other, or through a bayonet fitting.

Thus, the consumable component may comprise one or more engagement portions for engaging with the device. In this way, one end of the consumable component (i.e., the inlet end) may be coupled with the device, while an opposing end (i.e., the outlet end) of the consumable component may define a mouthpiece.

The consumable component may comprise an electrical interface for interfacing with a corresponding electrical interface of the device. One or both of the electrical interfaces may include one or more electrical contacts. Thus, when the device is engaged with the consumable component, the electrical interface may be configured to transfer electrical power from the power source to a heating element of the consumable component. The electrical interface may also be used to identify the consumable component from a list of known types. The electrical interface may additionally or alternatively be used to identify when the consumable component is connected to the device.

The device may alternatively or additionally be able to detect information about the consumable component via an RFID reader, a barcode or QR code reader. This interface may be able to identify a characteristic (e.g., a type) of the consumable. In this respect, the consumable component may include any one or more of an RFID chip, a barcode or QR code, or memory within which is an identifier and which can be interrogated via the interface.

In other embodiments, the component may be integrally formed with the aerosol-delivery (e.g., a smoking substitute) device to form the aerosol-delivery (e.g., s smoking substitute) system.

In such embodiments, the aerosol former (e.g., e-liquid) may be replenished by re-filling a tank that is integral with the device (rather than replacing the consumable). Access to the tank (for re-filling of the e-liquid) may be provided via, e.g., an opening to the tank that is sealable with a closure (e.g., a cap).

Further features of the device are described below. These are applicable to both the device for receiving a consumable component and to the device integral with the component.

The device may comprise a power source. The device may comprise a controller.

A memory may be provided and may be operatively connected to the controller. The memory may include non-volatile memory. The memory may include instructions which, when implemented, cause the controller to perform certain tasks or steps of a method. The device may comprise a wireless interface, which may be configured to communicate wirelessly with another device, for example a mobile device, e.g., via Bluetooth®. To this end, the wireless interface could include a Bluetooth® antenna. Other wireless communication interfaces, e.g., WIFI®, are also possible. The wireless interface may also be configured to communicate wirelessly with a remote server.

An airflow (i.e., puff) sensor may be provided that is configured to detect a puff (i.e., inhalation from a user). The airflow sensor may be operatively connected to the controller so as to be able to provide a signal to the controller that is indicative of a puff state (i.e., puffing or not puffing). The airflow sensor may, for example, be in the form of a pressure sensor or an acoustic sensor. The controller may control power supply to a heating element in response to airflow detection by the sensor. The control may be in the form of activation of the heating element in response to a detected airflow. The airflow sensor may form part of the device.

In a fourth aspect there is provided a method of using the aerosol-delivery (e.g., smoking substitute) consumable component according to the first or second aspect, the method comprising engaging the consumable component with an aerosol-delivery (e.g., smoking substitute) device (as described above) having a power source so as to electrically connect the power source to the consumable component (i.e., to the vaporizer of the consumable component).

The disclosure includes the combination of the aspects and preferred features described except where such a combination is clearly impermissible or expressly avoided.

BRIEF DESCRIPTION OF THE DRAWINGS

So that further aspects and features thereof may be appreciated, embodiments will now be discussed in further detail with reference to the accompanying figures, in which.

DETAILED DESCRIPTION OF THE EMBODIMENTS

Aspects and embodiments will now be discussed with reference to the accompanying figures. Further aspects and embodiments will be apparent to those skilled in the art.

Figure 1A:
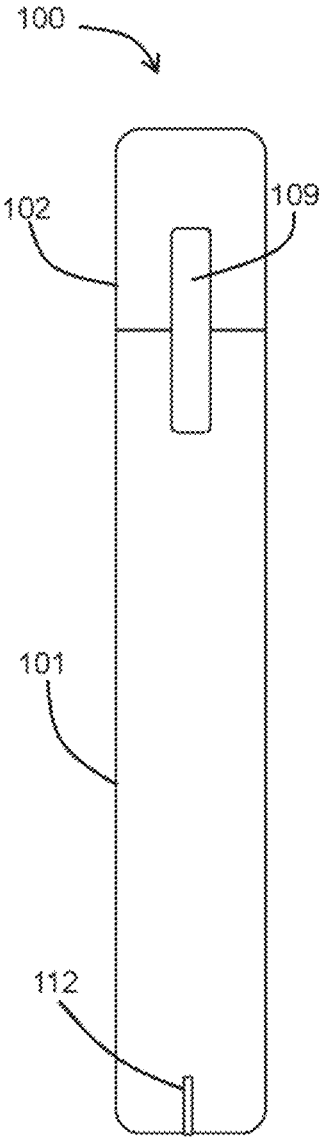
FIG. 1A is a front schematic view of a smoking substitute system.

FIG. 1A shows a smoking substitute system 100. In this example, the smoking substitute system 100 includes a device 101 and an aerosol delivery consumable component 102. The consumable component 102 may alternatively be referred to as a "pod", "cartridge" or "cartomizer". It should be appreciated that in other examples (i.e., open systems), the device may be integral with the component. In such systems, a tank of the aerosol delivery component may be accessible for refilling the system.

Figure 1B:
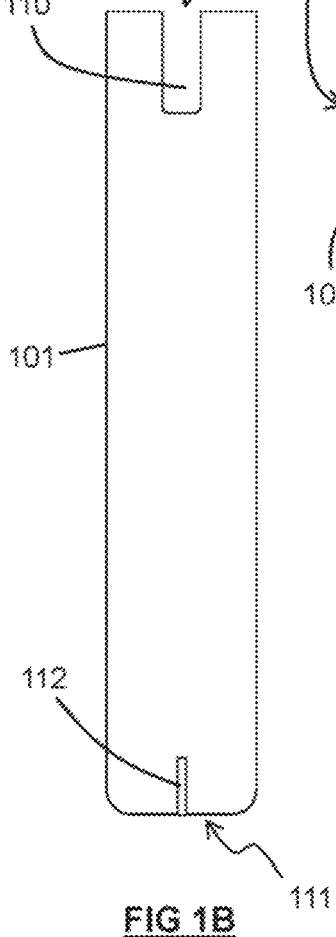
FIG. 1B is a front schematic view of a device of the system.
Figure 1C:
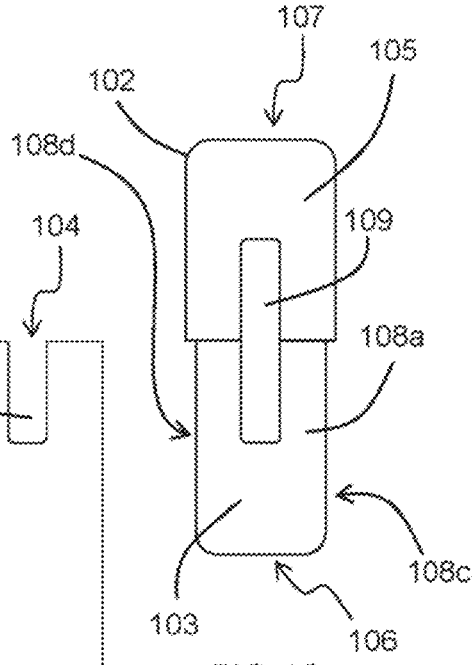
FIG. 1C is a front schematic view of a consumable of the system.

In this example, the smoking substitute system 100 is a closed system vaping system, wherein the consumable component 102 includes a sealed tank 103 and is intended for single-use only. The consumable component 102 is removably engageable with the device 101 (i.e., for removal and replacement). FIG. 1A shows the smoking substitute system 100 with the device 101 physically coupled to the consumable component 102, FIG. 1B shows the device 101 of the smoking substitute system 100 without the consumable component 102, and FIG. 1C shows the consumable component 102 of the smoking substitute system 100 without the device 101.

The device 101 and the consumable component 102 are configured to be physically coupled together by pushing the consumable component 102 into a cavity at an upper end 104 of the device 101, such that there is an interference fit between the device 101 and the consumable component 102. In other examples, the device 101 and the consumable component 102 may be coupled by screwing one onto the other, or through a bayonet fitting.

The consumable component 102 comprises a housing 105 having a base portion 106 (at a lower end), a mouthpiece 107 (at an upper end), and walls extending longitudinally from the base portion 106 to the mouthpiece 107. In particular, the consumable component 102 comprises front 108*a* and rear walls spaced by opposing first 108*c* and second 108*d* side walls. The distance between the front 108*a* and rear 108*b* walls defines a depth of the housing 105 and the distance between the side walls 108*c*, 108*d* defines a width of the housing 105. The width of the housing 105 is greater than the depth of the housing 105.

The tank 103 of the consumable component 102 comprises a window 109, which allows the quantity of e-liquid remaining in the tank 103 to be visually assessed. The device 101 includes a slot 110 so that the window 109 of the consumable component 102 can be seen whilst the rest of the tank 103 is obscured from view when the consumable component 102 is inserted into the cavity at the upper end 108 of the device 101.

A lower end 111 of the device 101 includes a light 112 (e.g., an LED) located behind a small translucent cover. The light 112 may be configured to illuminate when the smoking substitute system 100 is activated. Whilst not shown, the consumable component 102 may identify itself to the device 101, via an electrical interface, RFID chip, or barcode.

Figure 2A:
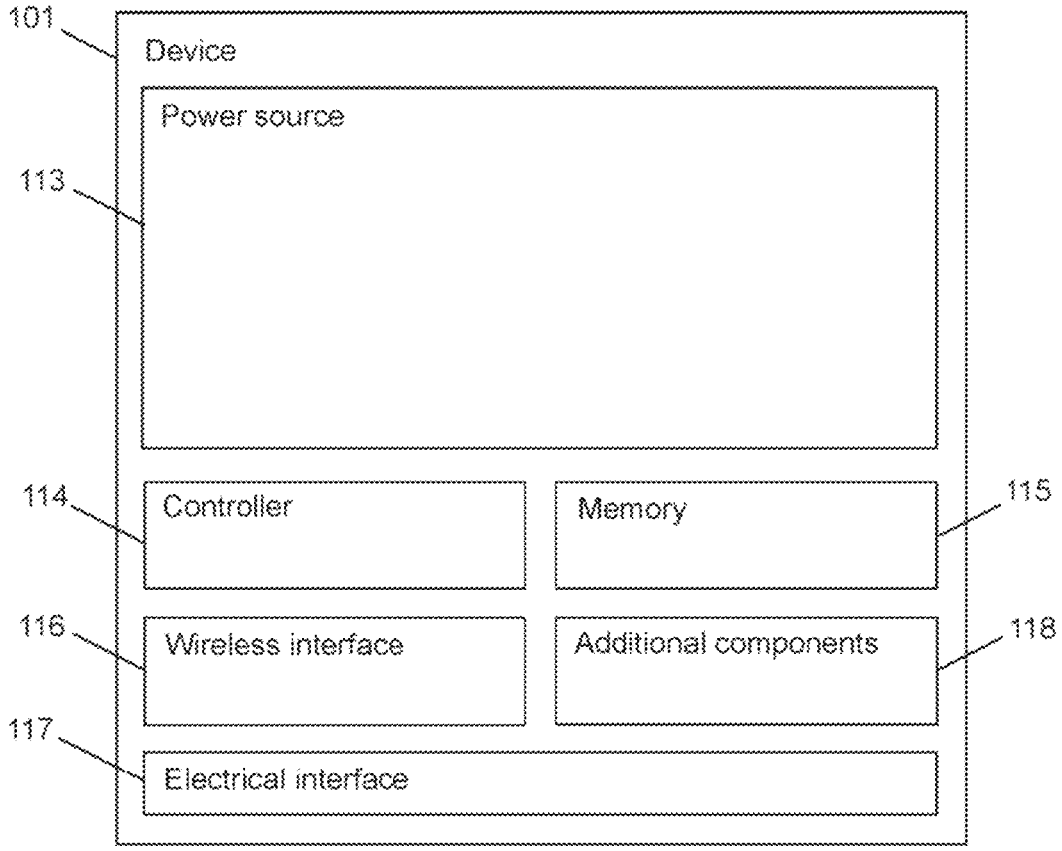
FIG. 2A is a schematic of the components of the device.
Figure 2B:
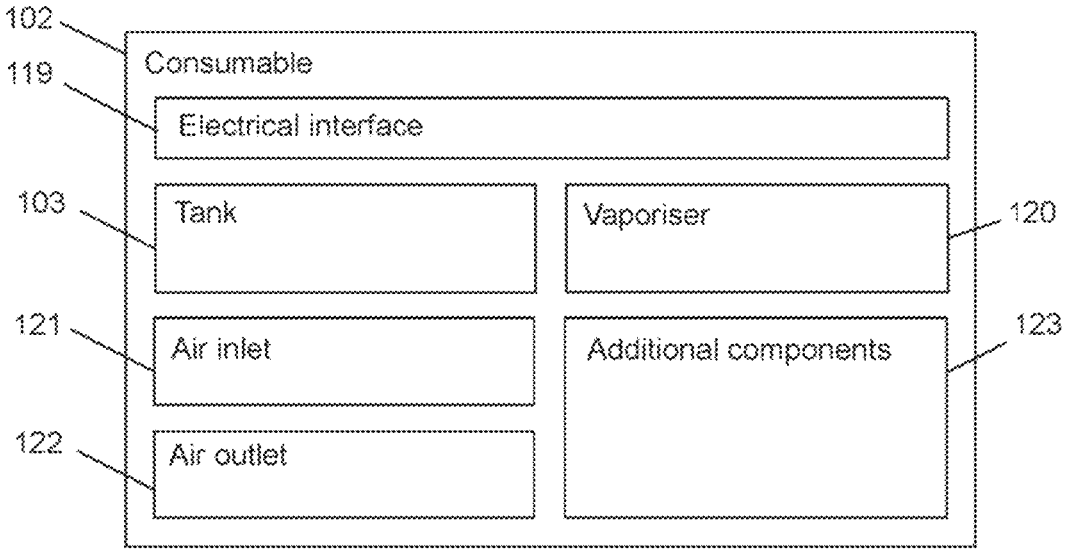
FIG. 2B is a schematic of the components of the consumable.

FIGS. 2A and 2B are schematic drawings of the device 101 and consumable component 102. These figures provide an overview of the components that form part of the consumable component 102 and device 101. As is apparent from FIG. 2A, the device 101 includes a power source 113, a controller 114, a memory 115, a wireless interface 116, an electrical interface 117, and, optionally, one or more additional components 118.

The power source 113 is a battery (e.g., a rechargeable battery). The controller 114 may, for example, include a microprocessor. The memory 115 may include non-volatile memory. The memory 115 may include instructions which, when implemented, cause the controller 114 to perform certain tasks or steps of a method.

The wireless interface 116 may be configured to communicate wirelessly with another device, for example a mobile device, e.g., via Bluetooth®. To this end, the wireless interface 116 could include a Bluetooth® antenna. Other wireless communication interfaces, e.g., WIFI®, are also possible. The wireless interface 116 may also be configured to communicate wirelessly with a remote server.

The electrical interface 117 of the device 101 may include one or more electrical contacts. The electrical interface 117 may be located in a base of the cavity formed in the upper end 104 of the device 101. When the device 101 is physically coupled to the consumable component 102, the electrical interface 117 of the device 101 is configured to transfer electrical power from the power source 113 to the consumable component 102 (i.e., upon activation of the smoking substitute system 100).

The electrical interface 117 may be configured to receive power from a charging station when the device 101 is not physically coupled to the consumable component 102 and is instead coupled to the charging station. The electrical interface 117 may also be used to identify the consumable component 102 from a list of known consumables. For example, the consumable component 102 may include e-liquid having a particular flavor and/or having a certain concentration of nicotine (which may be identified by the electrical interface 117). This can be indicated to the controller 114 of the device 101 when the consumable component 102 is connected to the device 101. Additionally, or alternatively, there may be a separate communication interface provided in the device 101 and a corresponding communication interface in the consumable component 102 such that, when connected, the consumable component 102 can identify itself to the device 101.

The additional components 118 of the device 101 may comprise an indicator (e.g., the light 112 discussed above), a charging portion, a battery charging control circuit, a sensor or, e.g., user input.

The charging port (e.g., USB or micro-USB port) may be configured to receive power from the charging station (i.e., when the power source 118 is a rechargeable battery). This may be located at the lower end 111 of the device 101. Alternatively, the electrical interface 117 discussed above may be configured to act as a charging port configured to receive power from the charging station such that a separate charging port is not required.

The battery charging control circuit may be configured for controlling the charging of the rechargeable battery. However, a battery charging control circuit could equally be located in the charging station (if present).

The sensor may be, e.g., an airflow (i.e., puff) sensor for detecting airflow in the smoking substitute system 100, e.g., caused by a user inhaling through a mouthpiece 107 of the consumable component 102. The smoking substitute system 100 may be configured to be activated when airflow is detected by the airflow sensor. This sensor could alternatively be included in the consumable component 102. The airflow sensor can be used to determine, for example, how heavily a user draws on the mouthpiece 107 or how many times a user draws on the mouthpiece 107 in a particular time period.

The user input may be a button. The smoking substitute system 100 may be configured to be activated when a user interacts with the user input (e.g., presses the button). This provides an alternative to the airflow sensor as a mechanism for activating the smoking substitute system 100.

The consumable component 102, which is shown in FIG. 2B, includes the tank 103, an electrical interface 119, a vaporizer 120, an air inlet 121, an air outlet 122 (e.g., formed in the mouthpiece 107), and one or more additional components 123.

The electrical interface 119 of the consumable component 102 may include one or more electrical contacts. The electrical interface 117 of the device 101 and the electrical interface 119 of the consumable component 102 may be configured to contact each other and thereby electrically couple the device 101 to the consumable component 102 when the base portion 106 of the consumable component 102 is inserted into the cavity formed in the upper end 104 of the device 101 (as shown in FIG. 1A). In this way, electrical energy (e.g., in the form of an electrical current) is able to be supplied from the power source 113 in the device 101 to the vaporizer 120 in the consumable component 102.

The vaporizer 120 is configured to heat and vaporize e-liquid contained in the tank 103 using electrical energy supplied from the power source 113. As will be described further below, the vaporizer 120 heats the e-liquid received from the tank 103 to vaporize the e-liquid. The air inlet 121 is configured to allow air to be drawn into the smoking substitute system 100 when a user inhales using the air outlet 122 formed in the mouthpiece 107, such that the vaporized e-liquid is drawn through the consumable component 102 for inhalation by the user.

In operation, a user activates the smoking substitute system 100, e.g., through interaction with a user input forming part of the device 101 or by inhaling through the air outlet 122 as described above. Upon activation, the controller 114 may supply electrical energy from the power source 113 to the vaporizer 120 (via electrical interfaces 117, 119), which may cause the vaporizer 120 to heat e-liquid drawn from the tank 103 to produce a vapor which is inhaled by a user through the mouthpiece 107.

An example of one of the one or more additional components 123 of the consumable component 102 is an interface for obtaining an identifier of the consumable component 102. As discussed above, this interface may be, for example, an RFID reader, a barcode, a QR code reader, or an electronic interface which is able to identify the consumable component 102. The consumable component 102 may, therefore include any one or more of an RFID chip, a barcode or QR code, or memory within which is an identifier and which can be interrogated via the electronic interface 117 in the device 101.

It should be appreciated that the smoking substitute system 100 shown in FIGS. 1A to 2B is just one exemplary implementation of a smoking substitute system 100. For example, the system could otherwise be in the form of an entirely disposable (single-use) system or an open system in which the tank is refillable (rather than replaceable).

Figure 3A:
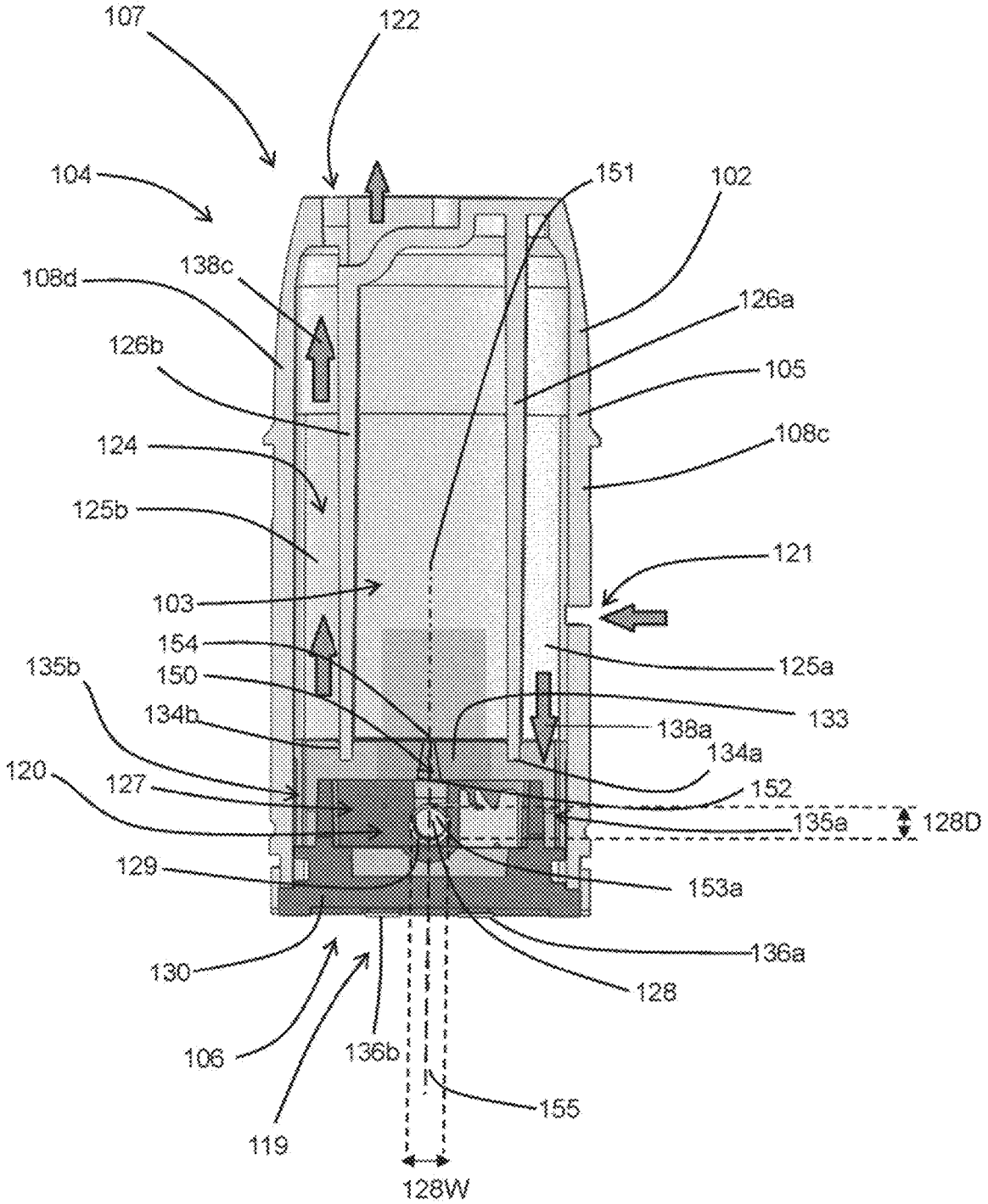
FIG. 3A is a front section view of the consumable.
Figure 3B:
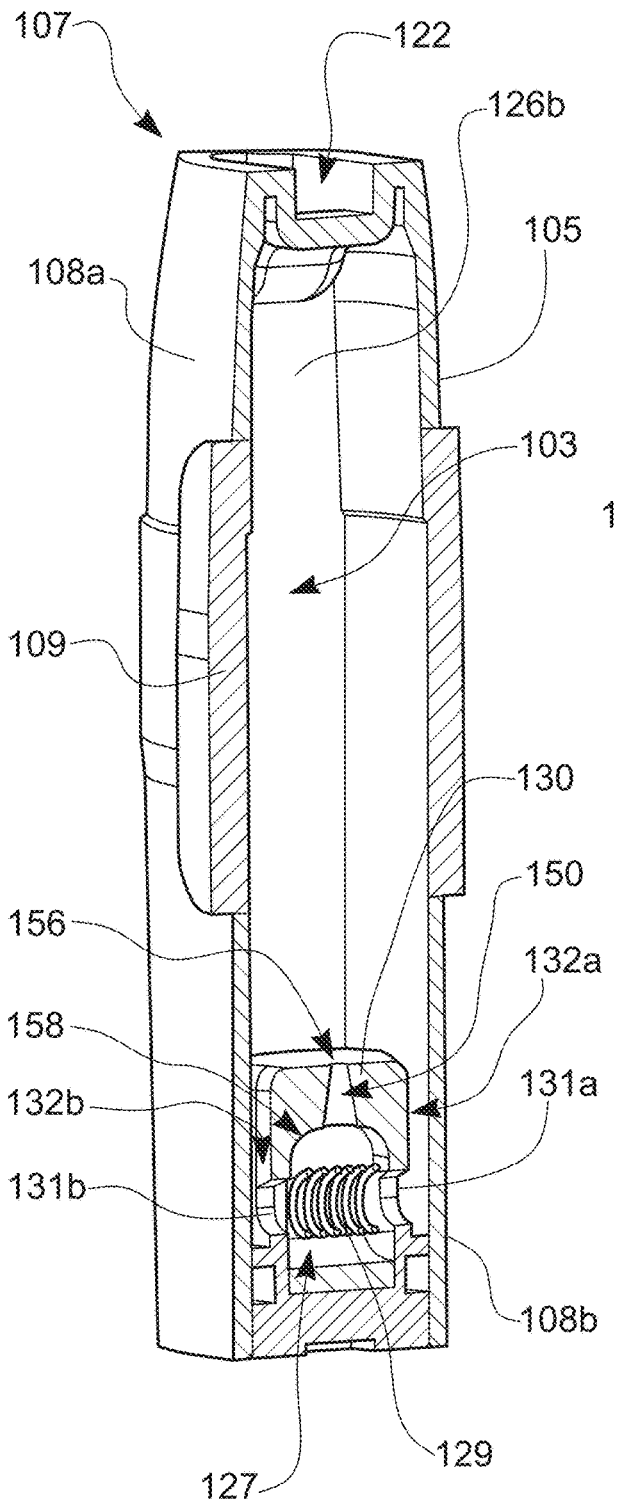
FIG. 3B is a perspective section view of the consumable.
Figure 3C:
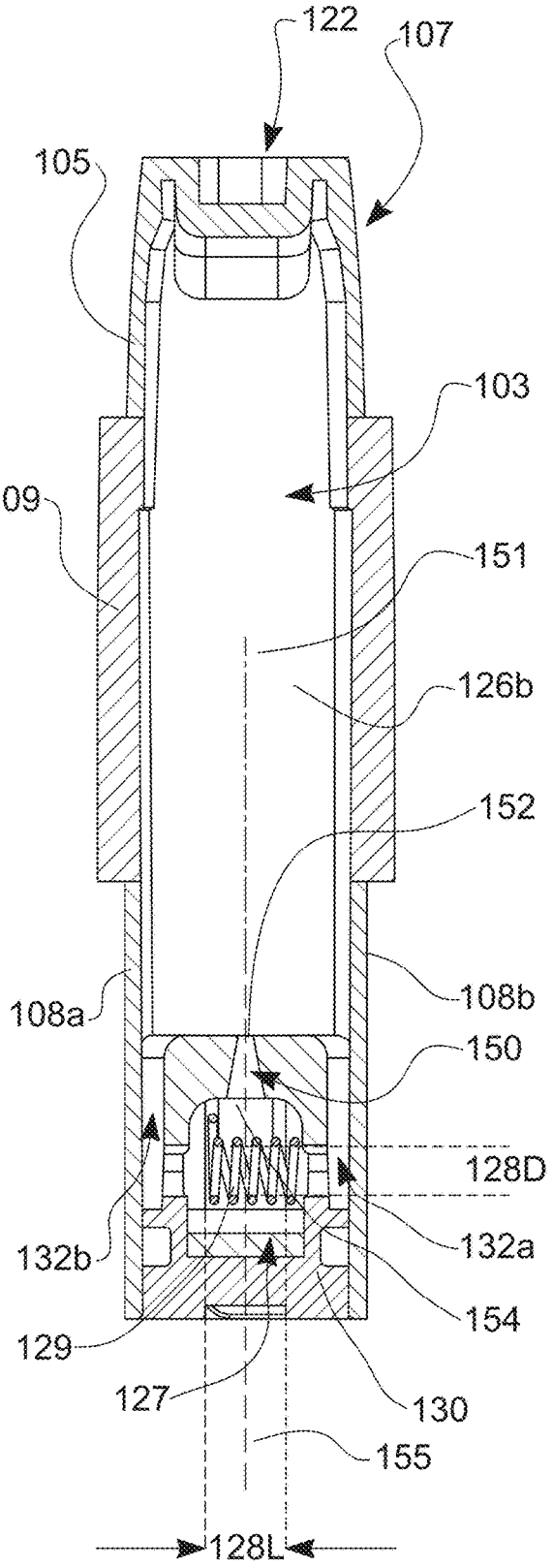
FIG. 3C is a side section view of the consumable.

FIGS. 3A, 3B and 3C are section views of the consumable component 102 described above. The air inlet 121 of the consumable component 102 is in the form of an aperture formed in the first side wall 108*c* of the housing 105. In particular, the air inlet 121 is spaced along the first side wall 108*c* (in a longitudinal direction) from the base portion 106 of the housing 105 so as to be partway along the first side wall 108*c* from the base portion 106. The air outlet 122 is formed in the mouthpiece 107 and an airflow path 124 extends from the air inlet 121 to the air outlet 122, such that a user can draw air through the airflow path 124 by inhaling at the air outlet 122. As will be described in more detail below, the airflow path 124 follows a generally U-shaped path through the consumable component 102.

The airflow path 124 comprises first 138*a*, second and third 138*c* airflow path portions. The first airflow path portion is defined by an inlet passage 125*a* extending longitudinally from the air inlet 121 towards the base portion 106 of the consumable component 102. This inlet passage 125*a* is defined between a first tank wall 126*a* that is laterally (i.e., transversely) spaced from the first side wall 108*c* (in which the air inlet 121 is formed) and that extends longitudinally from an internal surface of the mouthpiece 107.

The third airflow path is similarly defined by an outlet passage 125*b* that is formed between a second tank wall 126*b* and the second side wall 108*d*. The second tank wall 126*b* extends longitudinally from an internal surface of the mouthpiece 107 and is laterally spaced from the second side wall 108*d*. Both the first 126*a* and second 126*b* tank walls span the front 108*a* and rear 108*b* (see FIG. 3B) walls of the housing 105. In this way, the tank 103 is partly defined between the first and second tank walls 126*a*, 126*b*, the front 108*a* and rear 108*b* walls, and an internal surface of the mouthpiece 107.

The tank walls 126*a*, 126*b* and the mouthpiece 107 are integrally formed with each other so as to form a single unitary component that may, e.g., be formed by way of an injection molding process. Such a component may be formed of a thermoplastic material such as polypropylene. To facilitate this (e.g., to allow removal from a mold), each of the tank walls 126*a*, 126*b* is tapered from a proximal end at which it is connected to the mouthpiece 107 to an opposing distal end.

The second airflow path portion is in the form of a vaporizing chamber 127 that extends transversely across the housing 105 so as to connect lower ends of the first 125*a* and second 125*b* passages. Thus, upon inhalation by a user, air may flow into the inlet 121, through the inlet passage 125*a*, through the vaporizing chamber 127 (where vapor may be entrained in the air) and subsequently through the outlet passage 125*b* where it is discharged (into a user's mouth) from the outlet 122 at an upper end of the outlet passage 125*b*. Thus, the airflow path 124 comprises at least two turns (at the inlet 121 and the connection between the vaporizing chamber 127 and the inlet passage 125*a*) between the vaporizer chamber 127 and the inlet 121. This may reduce the propensity for leakage of e-liquid out of the inlet 121 (i.e., from the vaporizing chamber 127).

The vaporizer 120 is located in the vaporizing chamber 127 and comprises a porous wick 128 and a heater filament 129 coiled around the porous wick 128. The wick 128 extends across the vaporizing chamber 127 (perpendicular to the direction of airflow through the chamber 127). That is, the wick 128 extends in the depth direction of the housing 105.

The vaporizing chamber 127 is formed within an insert 130 that is received in an open lower end of the housing 105 so as to define the base portion 106 of the consumable component 102. The insert 130 seals against the walls of the housing 105 so as to define a lower end of the tank 103. Thus, the walls of the insert 130 (defining the vaporizing chamber 127) separate the vaporizing chamber 127 from the tank 106. In particular, an upper transverse wall 133 of the insert 130 extends from the first tank wall 126*a* to the second tank wall 126*b* so as to separate the vaporizing chamber 127 from the tank 103 (and so as to define a lower surface of the tank 103).

To form a seal with the tank walls 126*a*, 126*b*, the upper wall comprises grooves 134*a*, 134*b* that extend in a direction of the depth of the housing 105 and receive distal ends of the tank walls 126*a*, 126*b*. This arrangement also seals the tank 103 from the air passages 125*a*, 125*b*, which connect to the vaporizing chamber 127 via respective channels 135*a*, 135*b* formed in the insert 130.

As shown in FIG. 3B, the insert 130 comprises two apertures 131*a*, 131*b* formed in opposing walls of the insert 130 for receipt of respective ends of the wick 128 therethrough. The insert 130 is spaced from each of the front 108*a* and rear 108*b* walls, such that gaps 132*a*, 132*b* are formed between the insert 130 and each of the front 108*a* and rear 108*b* walls. These gaps 132*a*, 132*b* are arranged such that the ends of the wick 128 projecting through the apertures 131*a*, 131*b* in the insert 134 are received in the gaps 132*a*, 132*b*. In this way, the ends of the wick 128 are in contact with aerosol precursor (e-liquid) stored in the tank 106. This e-liquid is transported along the wick 128 (e.g., by capillary action) to a central portion of the wick 128 that is exposed to airflow flowing through the vaporizing chamber 127. The transported e-liquid is heated by the heater filament 129 (when activated, e.g., by detection of inhalation), which causes the e-liquid to be vaporized and to be entrained in air flowing across the wick 128. This vaporized liquid may cool to form an aerosol in the passage 140, which may then be inhaled by a user.

The insert also 130 accommodates the electrical interface 119 of the consumable component 102. The electrical interface 119 comprises two electrical contacts 136*a*, 136*b* that are electrically connected to the heating filament 129. In this way, when the consumable component 102 is engaged with the device 101, power can be supplied from the power source 113 of the device to the heating filament 129.

As shown in FIGS. 3A, 3B and 3C, the upper transverse wall 133 of the insert 130 separates the vaporizing chamber 127 from the tank 103 and includes a vent channel 150. The vent channel 150 extends through the transverse wall 133 from a first opening 152 at the vaporizing chamber 127 to a second opening 154 at the tank 103. The vent channel 150 is generally formed as an elongate tubular passage.

The longitudinal axis 151 of the elongate vent channel 150 intersects the vaporizer, which in this embodiment, includes an elongate cylindrical wick 128 with a length 128L that is greater than its width 128W and its depth 128D. The length 128L and width 128W are both perpendicular to the length 128L of the wick. The wick 128 extends transversely across the component and includes opposing first 153*a* and second 153*b* longitudinal ends.

Accordingly, the vent channel 150 is vertically above/vertically aligned with the wick 128.

The axis 151 of the vent channel 150 intersects the wick 128 at a position that is equally spaced from the first longitudinal end 153*a* and the second longitudinal end 153*b* of the wick 128. Thus, the vent channel 150 is transversely centered along the length 128L of the wick 128.

The axis 151 of the vent channel 150 intersects the longitudinal axis of the wick 128 such that the axis 151 of the vent channel 150 is centered in the width dimension 128W of the wick 128.

Accordingly, the axis 151 of the vent channel 150 is centered in both the length 128L and width 128W dimensions of the wick 128.

The first opening 152 is positioned such that it overlies the wick 128. The entire cross-sectional area of the first opening 152 overlies the wick 128. The maximum dimension of the first opening 152 is less than the smaller of the width 128W and length 128L dimension of the wick 128.

The first opening 152 is circular and the diameter of the first opening 152 is equal to or smaller than the smaller of the width 128W and length 128L dimensions of the wick 128. The second opening 154 is circular.

The first opening 152 has a greater cross-sectional area/diameter than the second opening 154. In this embodiment, the first opening 152 has a greater diameter than the second opening 154.

The vent channel 150 tapers evenly/uniformly and constantly outwardly from the second opening 154 to the first opening 152, i.e., the cross-sectional area of the vent channel 150 (in a plane extending perpendicularly to the longitudinal axis 151 of the vent channel 150) increases toward the first opening 152.

The vent channel 150 has a uniform circular cross-sectional profile, i.e., the cross-sectional profile/shape remains constant along the length of the vent channel 150. Accordingly, the vent channel 150 is frustoconical. The vent channel 150 is shaped as a hollow conical frustum.

The longitudinal axis 151 of the elongate vent channel 150 is coaxial with the elongate axis of the component.

The silicone insert 130 forms the walls of the vaporizing chamber 127 and separates the vaporizing chamber 127 from the tank 130. The insert 130 seals the vaporizing chamber 127 from the tank 103 other than at the vent channel 150 and the openings 131*a*, 131*b* through which the ends of the wick 128 project for contact with the aerosol precursor. The upper transverse wall 133 of the insert 130 includes an upper surface 156 which defines the lower end of the tank 103 and a lower surface 158 of the wall 133 which defines the upper end of the vaporizing chamber 127. The first opening 152 is formed in the lower surface 158 of the wall and the second opening 156 is formed in the upper surface 156 of the wall.

As described above, in use aerosol precursor is drawn from the tank 103 and into the wick 128. As the aerosol precursor is drawn out from the tank 103, a pressure differential is created between the inside of the tank 103 and the vaporizing chamber 127. This pressure difference causes air to be drawn into the tank 103 via the vent channel 150.

Air is thus able to enter the tank 103 and replace the volume created by the vaporized aerosol precursor. By allowing air to enter the tank 103, the pressure differential between the tank 103 and the vaporizing chamber 127 is equalized. Further aerosol precursor can therefore be released or drawn out from the tank 103 by the wick 128 as needed.

As described above, air passes through the vent channel 150 and into the tank 103. Liquid aerosol precursor in the tank 103 may leak from the tank 103 through the vent channel 150. Any liquid aerosol precursor that leaks from the tank 103 through the vent channel 150 is discharged onto the wick 128. The aerosol precursor that leaks onto the wick 128 can be heated and vaporized as described above.

In a further embodiment, in which the component is the same as that shown in FIGS. 3A, 3B, 3C, the second opening 154 is sized to prevent flow of liquid aerosol precursor therethrough. The second opening 154, or specifically the cross-sectional area of the second opening 154, may thus be sufficiently small to prevent flow of liquid aerosol precursor through the vent channel 150. In practice, the second opening 154 is sufficiently small such that the surface tension of the liquid aerosol precursor prevents the liquid aerosol precursor from passing through the second opening 154. In such an embodiment, the second opening 154 prevents liquid aerosol precursor from leaking from the tank 103 and into the vaporizing chamber 127. The vent channel 150 is sized to allow air to pass therethrough. In particular, the first 152 and second 154 openings are sized to allow air to pass therethrough. Specifically, the cross-sectional areas of the first 152 and second 154 openings are sufficiently large to allow air to pass through them. Air is therefore able to pass freely through the first and second openings 152, 154 of the vent channel 150. In other words, air is flowable from the vaporizing chamber 127 through the first opening 152 and into the tank through the second opening 154.

While exemplary embodiments have been described above, many equivalent modifications and variations will be apparent to those skilled in the art when given this disclosure. Accordingly, the exemplary embodiments set forth above are considered to be illustrative and not limiting.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the disclosure that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

What is claimed is:

1. An aerosol-delivery component comprising:

a tank for containing a liquid aerosol precursor;

a vaporizing chamber housing a vaporizer;

a wall separating the vaporizing chamber from the tank; and a vent channel having a longitudinal axis, the vent channel extending through the wall from a first opening at the vaporizing chamber to a second opening at the tank, the longitudinal axis of the vent channel being configured to intersect the vaporizer such that leakage of aerosol precursor through the channel is discharged onto the vaporizer.

2. A component according to claim 1 wherein there is a clear, unobstructed pathway between the first opening and the vaporizer.

3. A component according to claim 1 wherein the vaporizer has a length and a width dimension perpendicular to a longitudinal axis of the component and wherein the longitudinal axis of the vent channel intersects the width and/or length dimension of the vaporizer.

4. A component according to claim 3 wherein the axis of the vent channel intersects the vaporizer at a position that is equi-distant from first and second longitudinal ends of the vaporizer such that the vent channel is transversely centered along the length of the vaporizer.

5. A component according to claim 1 wherein the axis of the vent channel intersects a longitudinal axis of the vaporizer.

6. A component according to claim 1 wherein at least a portion of the first opening is positioned such that it overlies the vaporizer; optionally wherein the maximum dimension of the first opening is less than or equal to the smaller of the width and length dimension of the vaporizer; optionally wherein the first opening is circular and the diameter of the first opening is equal to or smaller than the width dimension of the vaporizer.

7. A component according to claim 1 wherein the first opening has a greater cross-sectional area than the second opening.

8. A component according to claim 1 wherein the vent channel is frustoconical.

9. A component according to claim 1 wherein the longitudinal axis of the vent channel is parallel to the longitudinal axis of the component.

10. An aerosol-delivery component comprising:

a tank for containing a liquid aerosol precursor;

a vaporizing chamber;

a transverse wall separating the vaporizing chamber from the tank; and a vent channel comprising an elongate channel extending through the transverse wall from a first opening at the vaporizing chamber to a second opening at the tank, the first opening having a greater cross-sectional area than the second opening, wherein the axis of the elongate channel is axially aligned with a longitudinal axis of the component.

11. A component according to claim 10, wherein the elongate channel tapers outwardly from the second opening to the first opening.

12. A component according to claim 10 wherein the vent channel tapers uniformly between the first and second openings.

13. A component according to claim 10 wherein the vent channel has a uniform transverse cross-sectional profile along its length.

14. A component according to claim 13 wherein the vent channel has a circular cross-sectional profile; optionally wherein the vent channel is frustoconical.

15. A component according to claim 10 wherein the vaporizing chamber comprises a vaporizer having an elongate wick and wherein the vent channel is vertically aligned with the wick.

* * * * *